US006941582B2

(12) United States Patent
Miska

(10) Patent No.: US 6,941,582 B2
(45) Date of Patent: Sep. 13, 2005

(54) NOVELTY HEAD COVERING

(75) Inventor: Todd Miska, Bloomington, MN (US)

(73) Assignee: Promo Mask, Inc., Bloomington, MN (US)

( * ) Notice: Subject to any disclaimer, the term of this patent is extended or adjusted under 35 U.S.C. 154(b) by 110 days.

(21) Appl. No.: 10/403,932

(22) Filed: Mar. 31, 2003

(65) Prior Publication Data

US 2004/0055071 A1 Mar. 25, 2004

Related U.S. Application Data

(63) Continuation of application No. 29/159,620, filed on Apr. 25, 2002, now Pat. No. Des. 480,761, and a continuation of application No. 29/127,139, filed on Jul. 31, 2000, now Pat. No. Des. 472,934, and a continuation of application No. 29/126,716, filed on Jul. 22, 2000, now Pat. No. Des. 473,265, and a continuation of application No. 29/125,085, filed on Jun. 16, 2000, now Pat. No. Des. 472,582.

(51) Int. Cl.[7] ..... A42B 1/00
(52) U.S. Cl. ..... 2/200.3

(58) Field of Search ..... 2/200.3, 171, 200.1

(56) References Cited

U.S. PATENT DOCUMENTS

| | | | | | |
|---|---|---|---|---|---|
| 2,682,668 | A | * | 7/1954 | Hoeflich | 2/209.3 |
| 4,246,659 | A | * | 1/1981 | Lyons | 2/209.3 |
| 4,429,420 | A | * | 2/1984 | Wolff | 2/175.1 |
| 5,214,800 | A | * | 6/1993 | Braun | 2/173 |
| 5,428,842 | A | * | 7/1995 | Wise | 2/195.1 |

* cited by examiner

*Primary Examiner*—Katherine M Moran
(74) *Attorney, Agent, or Firm*—Larkin Hoffman Daly & Lindgren Ltd.; Thomas J. Oppold

(57) ABSTRACT

A head covering particularly adapted for use as a promotional item to be worn by patrons at sporting events and other types of entertainment venues. The head covering includes first, second and third panel sections which are adapted to cooperate to form a head covering that at least partially covers the head of a wearer. The panel sections comprising the head covering may be configured to simulate virtually any other object, thing or design that may be desired for a particular promotion, giveaway, or event.

3 Claims, 8 Drawing Sheets

NOVELTY HEAD COVERING

CROSS-REFERENCE TO RELATED APPLICATIONS

This application is a continuation of U.S. Design Application No. 29/125,085, now U.S. Pat. No. D472582, entitled Decorative Replica GoalTenders Mask, filed Jun. 16, 2000. This application is also a continuation of U.S. Design Application No. 29/126,716, now U.S. Pat. No. D473265, entitled Decorative Replica Football Helmet, filed Jul. 22, 2000. This application is also a continuation of U.S. Design Application No. 29/127,139, now U.S. Pat. No D472934, entitled Decorative Replica Motorsports Helmet, filed Jul. 31, 2000. This application is also a continuation of U.S. Design Application No. 29/159,620, now U.S. Pat. No. D480761, entitled Decorative Replica Baseball Batter's Mask, filed Apr. 25, 2002.

BACKGROUND OF THE INVENTION

The owners of sports and entertainment facilities, sports franchises, as well as promoters of sports and entertainment events, are continually searching for new ways to promote their team, entertainer or event and to increase revenues through the sale of souvenirs and novelty items. Examples of common promotional methods include the selling or giving away of T-shirts, hats, towels, bobble-head dolls, coupons, and the like, having the name, logos or designs of the team, entertainer or event prominently displayed thereon.

Accordingly it is desirable to provide a new promotional item which will enable owners and promoters of sporting and entertainment events to promote their interests while at the same time allowing fans or patrons at these events to show their support and excitement for the team, entertainer or event.

SUMMARY OF THE INVENTION

The present invention provides a head covering particularly adapted for use as a promotional item to be worn by patrons at sporting events and other types of entertainment venues but may be worn, used or displayed for other purposes as well. The head covering preferably comprise first, second and third panel sections which are adapted to cooperate to form a head covering that at least partially covers the head of a wearer.

The panel sections comprising the head covering may be configured to simulate helmets or masks used in sports activities such as football, baseball, hockey and motorsports or virtually any other type of head gear including, military helmets, firefighter helmet, and astronaut helmets. Other configurations may simulate different types of balls used in the various types of sports including, soccer, basketball, football, baseball, golf, volleyball, etc. Still other configurations may simulate various types of sporting event mascots, various types of animals, monsters, holiday figures or figurines, various types of food, well known public figures, corporate logos, or virtually any other object, thing or design that may be desired for a particular promotion, giveaway, or event.

DETAILED DESCRIPTION OF THE PREFERRED EMBODIMENTS OF THE INVENTION

Figure 1:
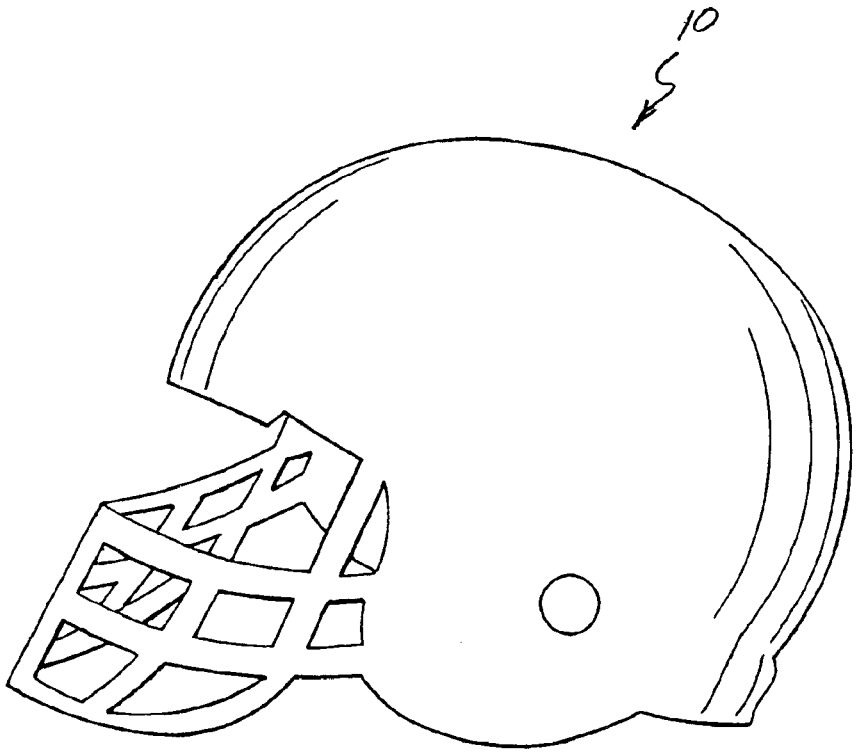
FIG. 1 is a side elevation view of one embodiment of the formed head covering of the present invention in which the head covering is configured as a football helmet.

Drawing FIGS. 1 through 8 illustrate various embodiments of the head covering 10 of the present invention wherein like reference numerals designate corresponding parts of the present invention throughout the several views. The head covering 10 is particularly adapted for use as a promotional item to be worn by patrons at sporting events and other types of entertainment venues but may be worn, used or displayed for other purposes as well.

The head covering 10 preferably comprises a first panel section 22, a second panel section 24 and a third panel section 26. As described in more detail later, the first, second and third panel sections are adapted to cooperate to form a head covering that at least partially covers the head of a wearer. It should be appreciated however, that more than three panel sections may be used to construct a head covering 10. Thus, the present invention should not be construed as limited to only head coverings comprising three panel sections.

As illustrated in FIGS. 1–8, the panel sections 22, 24, 26 may be configured such that they cooperate to simulate various types of helmets or masks used in sports activities such as football, baseball, hockey and motorsports. More detailed examples of such configurations are illustrated in U.S. Design Application Nos. 29/125,085; 29/126,716; 29/127,139 and 29/159,620, all of which are incorporated herein by reference in their entirety.

In addition to sport related helmets and masks, the panel sections 22, 24, 26 may be configured such that they cooperate to simulate virtually any other type of head gear including, military helmets, firefighter helmet, and astronaut helmets, to name but a few of the myriad of possibilities. Rather than simulating a helmet or mask, the panel sections 22, 24, 26 may be configured to cooperate to simulate other types of objects, such as different types of balls used in the various types of sports including, soccer, basketball, football, baseball, golf, volleyball, etc. Still other configurations may simulate various types of sporting event mascots, various types of animals, monsters, holiday figures or figurines, various types of food, well known public figures, corporate logos, or virtually any other object, thing or design that may be desired for a particular promotion, giveaway, or event. Thus, it should be appreciated that the configuration of the panel sections 22, 24, 26 for the simulation of various objects and things is virtually limitless.

The size of the panel sections may be such that they cooperate to form a head covering 10 just large enough to receive the wearer's head. Preferably, however, the panel sections are sized substantially larger, so as to create a disproportionately sized head covering as compared to the wearer's head and body. This not only adds to the amusement of the head covering 10, but also provides large panel sections 22, 24, 26 on which to apply artwork, text and designs. Thus, it should be appreciated that the ability to apply artwork, text and designs to the panel sections, makes the head covering 10 of the present invention particularly adapted and well suited for promotion and advertising purposes.

Figure 2:
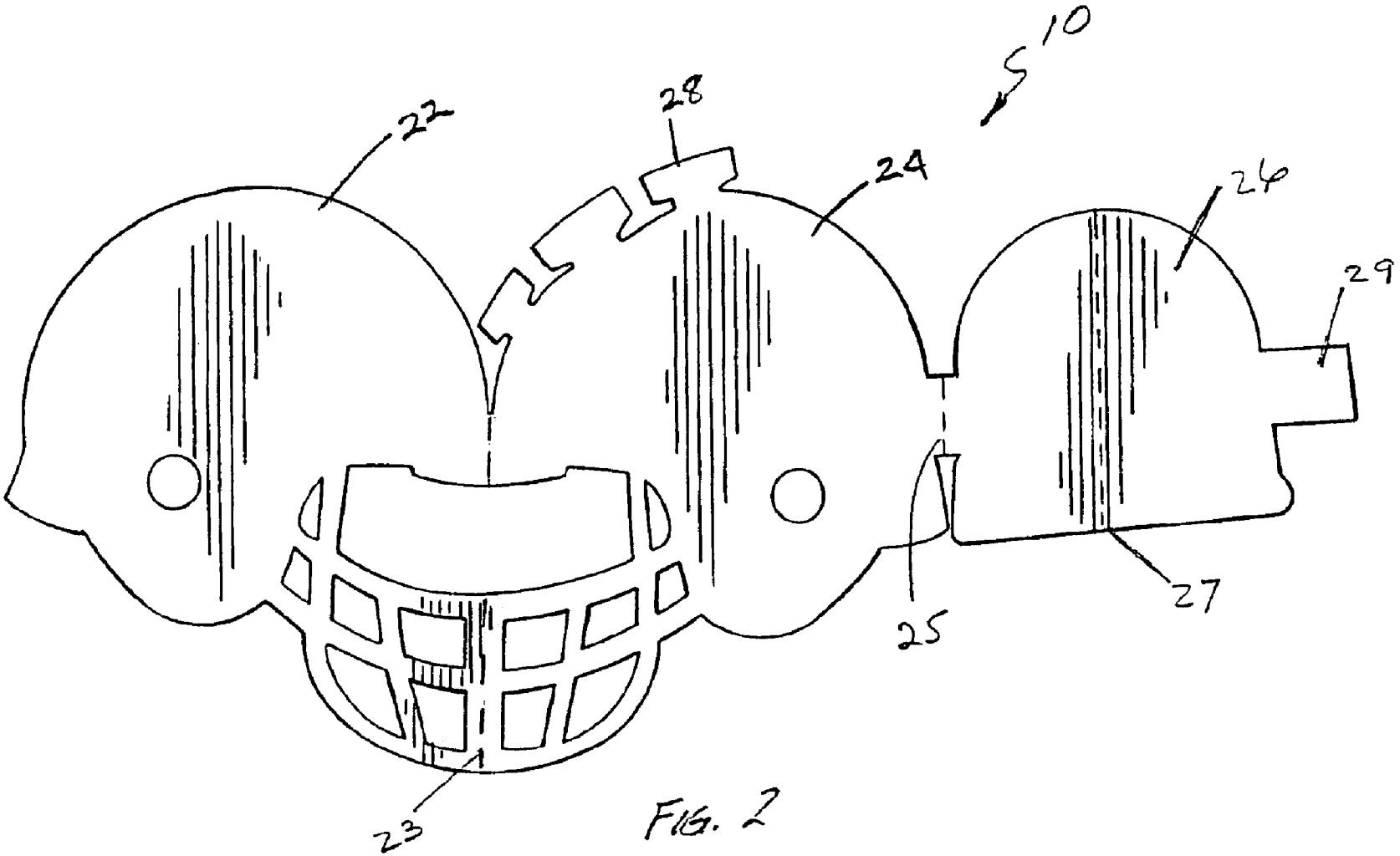
FIG. 2 is a plan view of the head covering of FIG. 1 illustrating the panel sections prior to being formed into the head covering.
Figure 6:
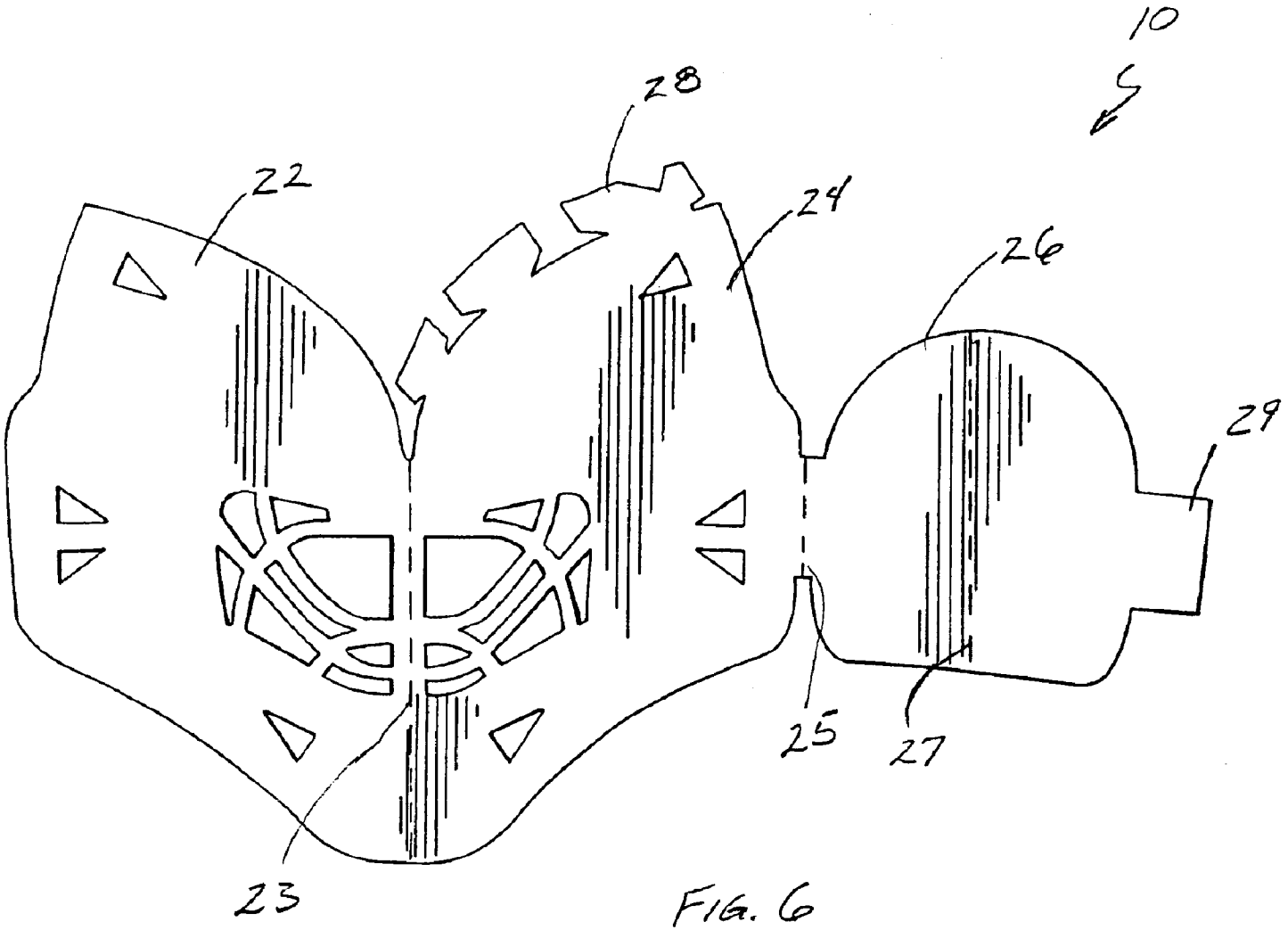
FIG. 6 is a plan view of a hockey mask embodiment of the head covering of the present invention illustrating the panel sections prior to being formed into the head covering.
Figure 7:
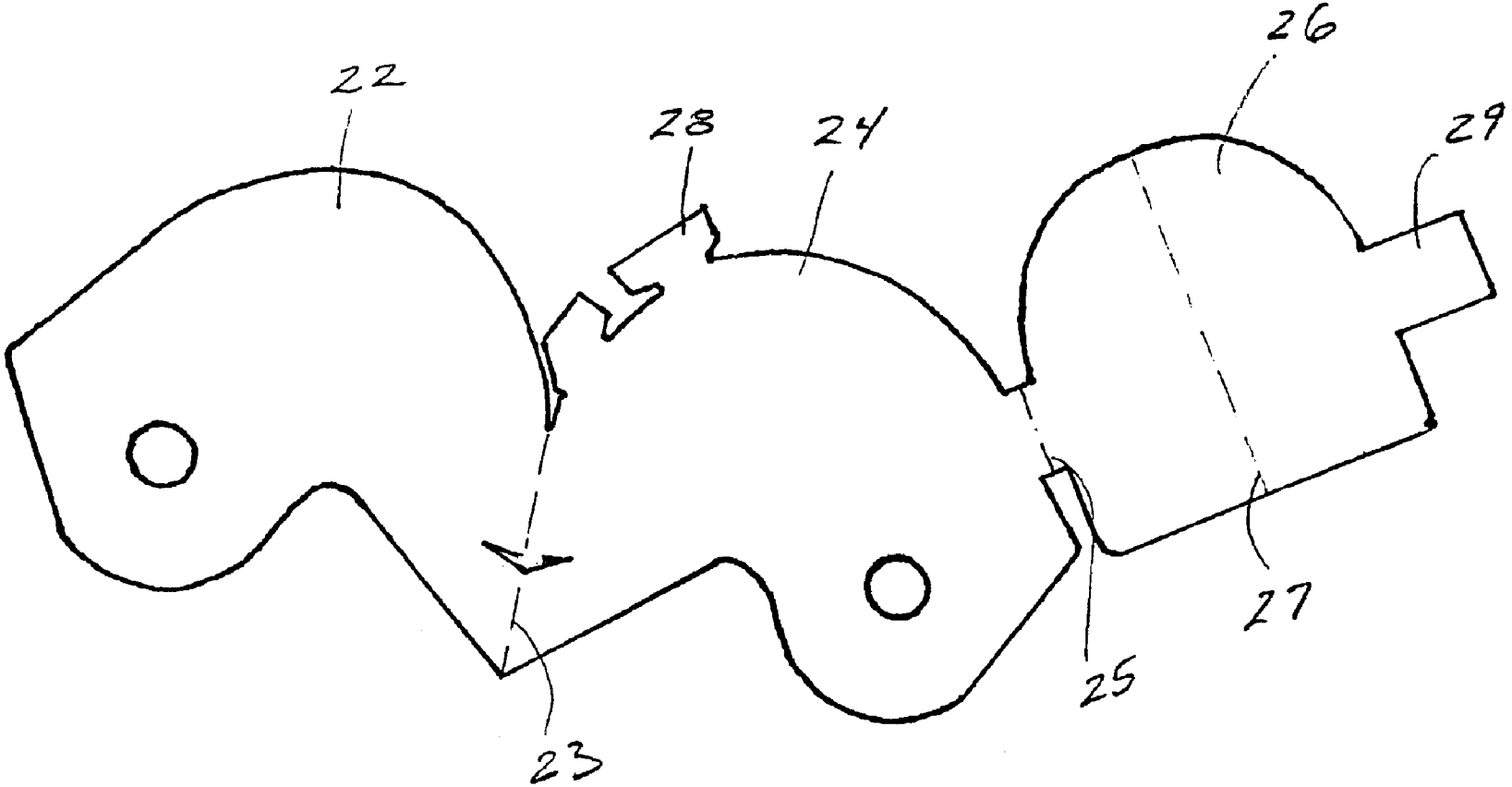
FIG. 7 is a plan view of a baseball batter's helmet embodiment of the head covering of the present invention illustrating the panel sections prior to being formed into the head covering.
Figure 8:
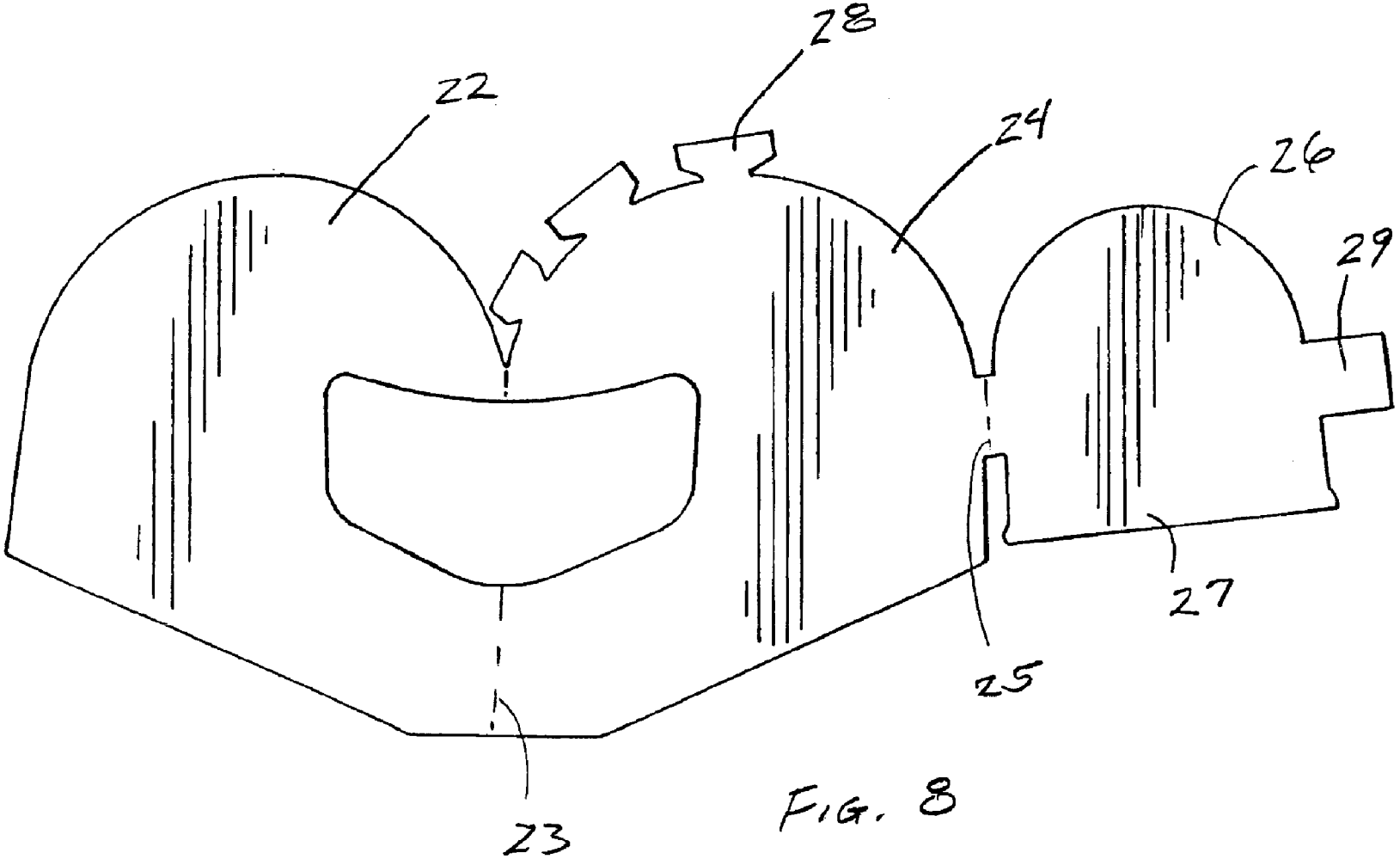
FIG. 8 is a plan view of the motorsports helmet embodiment of the head covering of the present invention illustrating the panel sections prior to being formed into the head covering.

Referring now to FIGS. 2, 6, 7, and 8, the panel sections 22, 24, 26 of the head covering 10 preferably comprise a singular or unitary panel which may be folded and joined to form the head covering 10. By way of example, one embodiment for such a panel for forming a football helmet head covering is illustrated in FIG. 2. An example of one embodiment for such a panel for forming a hockey mask head covering is illustrated in FIG. 6. An example of one embodiment for such a panel for forming a baseball batter's helmet is illustrated in FIG. 7 of the present invention. An example of one embodiment for such a panel for forming a motorsports helmet head covering is illustrated in FIG. 8.

In each of the sample embodiments illustrated in FIGS. 2, 6, 7, and 8, a fold line 23 is preferably incorporated between the first panel section 22 and a second panel section 24. Another fold line 25 is preferably included between the second panel section 24 and the third panel section 26. Similarly, a fold line 27 is preferably included in the third panel section 26 of the present invention. Other fold lines may be included as needed to form the head covering 10. Preferably, at least one of the first and second panel sections 22, 24 includes tabs or attachment points 28 used for joining or securing panel sections 22, 24 together when forming the head gear 10. Additionally, the first or third panel sections 22, 26 also preferably includes a tab or attachment point 29 used for joining or securing the first and third panel sections 22, 26 together when forming the head gear 10.

It should be appreciated that the placement and size of these tabs 28, 29 will vary depending on the configuration of the panel sections and the resulting size and shape of the head gear 10. As described below, the fold lines 23, 25, 27 and tabs 28, 29 enable the panel sections 22, 24, 26 to cooperate to more easily form the head covering 10. While it is preferred that the head covering 10 is formed from a single panel as just described, it should be appreciated that rather than the panel sections 22, 24, 26 comprising a single or unitary panel, the first, second and third panel sections may also be individual or separate panel sections that may be separately joined together as described below to form the head covering 10.

Figure 3:
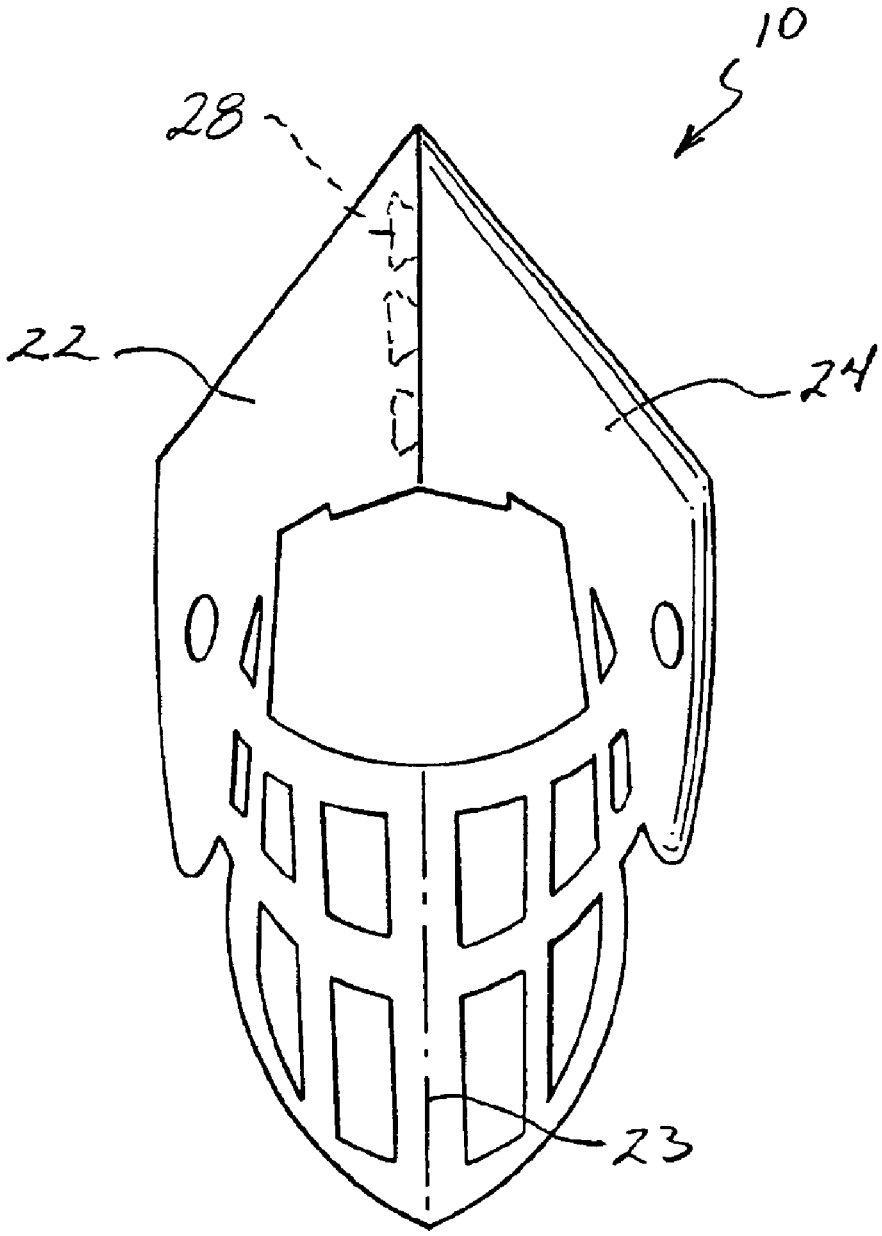
FIG. 3 is a front elevation view of the formed head covering of FIG. 1.

Continuing to refer to FIGS. 2, 6, 7 and 8, the first and second panel sections 22, 24 preferably form complementary opposite panel sections such that the panels mirror each other when the head covering is fully joined as shown in FIG. 3. However, depending on the head covering 10, the use of complimentary opposing first and second panel sections 22, 24 may not be possible or desired to achieve the final effect of the head covering 10 when the panel sections are joined together.

Figure 4:
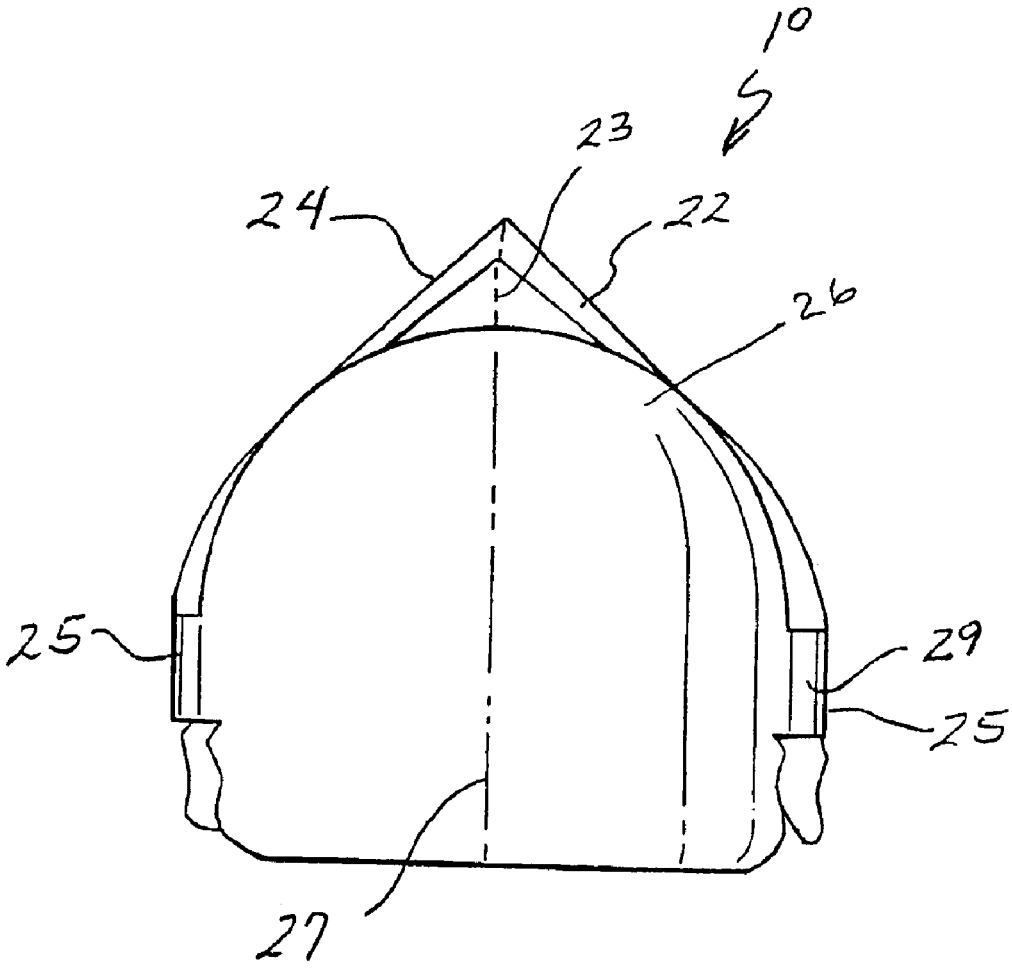
FIG. 4 is a rear elevation view of the formed head covering of FIG. 1.
Figure 5:
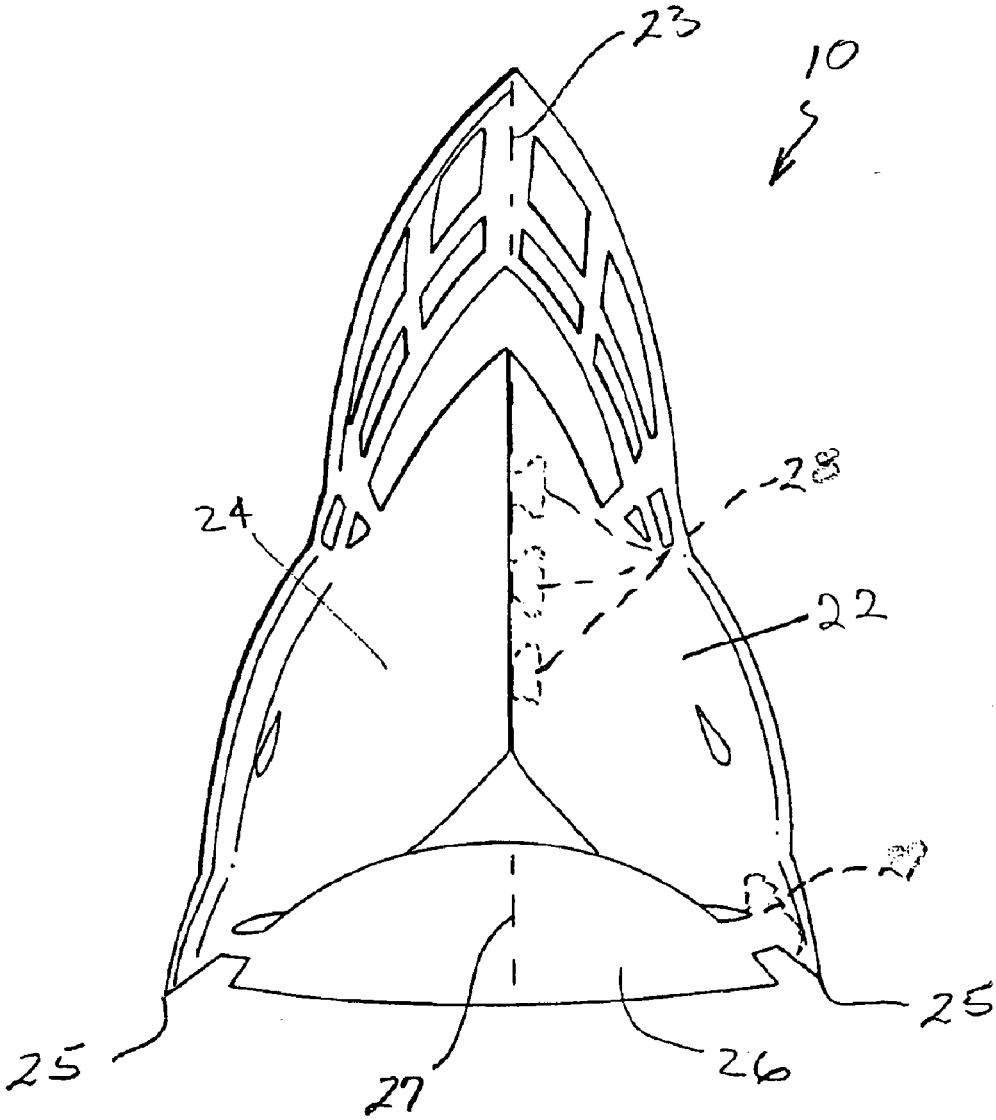
FIG. 5 is a top elevation view of the formed head covering of FIG. 1.

When forming the head covering 10 in which the panel sections comprise a single or unitary panel, the first and second panel sections 22, 24 are folded toward one another along fold line 23. As best illustrated in FIGS. 3 and 5, opposing edges of the first and second panel sections 22, 24 are then preferably joined together with the tabs 28. Also as best illustrated in FIGS. 4 and 5, the third panel section 26 is then folded toward the first panel section 22 and joined thereto with tab 29. The third panel section 26 is preferably configured to cooperate with the first and second panel sections 22, 24 to form the rear of the head covering such that the panel sections 22, 24, 26 cooperating to form a head covering to at least partially surround the head of a wearer.

The tabs 28, 29 may be joined or secured to the opposing or adjoining panel sections by any well known means, including the use of adhesive, staples, hook and loop fasteners, etc., or the tabs 28, 29 may be configured to insert into a slot (not shown) formed or cut into the adjoining panel section. Alternatively, rather than using tabs 28, the panel sections 22, 24, 26 may simply be joined along adjacent or adjoining edges by using any of the above methods or other methods recognized by those skilled in the art. Thus, it should be appreciated that method of joining the panel sections may depend on whether the maker desires to disassemble the head gear 10 after use or whether the maker desires to more permanently secure the panel sections together.

In the preferred embodiment, the panel sections are adhered or bonded together prior to shipment to ensure quality control and to eliminate the need on the part of vendors or end users to assemble the panel sections to form the head covering 10. To enable the head covering 10 to be easily shipped and stored, the joined panel sections are able to fold along fold lines 23, 25, and 27 such that the panel sections of the head covering 10 collapse into a substantially coplanar or flat arrangement. For example, in the folded position, the third panel section 26 may be folded out or in an extended position from the first and second panel sections. Alternatively, the third panel section 26 may be tucked between the first and second panel sections 22, 24 as shown in FIG. 4. When a user desires to wear the head covering, the user simply unfolds the head gear for placing on his or her head.

The head covering of the present invention may be made from any material that can be sustained through the required design and crafting processes and is suitable for the intended use as a novelty head covering. The process may include among others, stamping, die-cutting, hand cutting and the like. Materials usable to make the head covering of the present invention may include paper, plastic, laminates, cardboard, clothing, etc. A typical head covering of the present invention may be formed using an 18-point paper or material having similar properties such as the ability to retain a formed shape and strength.

The design of the head covering is preferably determined before the cutting or shaping of the material to be used for the head covering 10. As an example, a head covering 10 for promoting the Dallas Cowboys of the National Football League may be a football helmet having the same artwork as the player helmet. This artwork may traced, drawn, imaged or otherwise incorporated in the material useful for making the head covering. This step may be accomplished manually, with a specialized equipment, via computer-aided systems, by a combination of these or by other processes as is known to those skilled in the art. Typically, the design is introduced by first creating a computer based blueprint of the intended design, transferring the intended design to a color press, and imaging the intended design onto the material using a printer that is adaptable to print the intended design.

The printed design is preferably then cut out into the first, second and third panel sections 22, 24, 26 of the desired configuration as previously described. Depending on the material used, this cutting process may be accomplished manually, using a preset die, computer-assisted cutter, or any other suitable process as is known in the art. The design may incorporate guide points that may be used to locate the locations where the cuts are to be made in order to form the cut out panels for forming the head covering. After the imaged panel sections are cut into the desired configuration, the panels may then be joined manually or mechanically using any one or more of the methods previously described.

Having thus described the preferred embodiments of the present invention, those of skill in the art will readily appreciate that the teachings found herein may be applied to yet other embodiments within the scope of the appended claims.

What is claimed is:

1. A head covering, comprising:

a first panel section;

a second panel section;

a third panel section; and a tab;

said second panel section being a substantial mirror image of said first panel section and said second panel section joined to said first panel section along a first fold line wherein said first and second panel sections define left and right sides of a three sided head covering;

said second panel section joined to said third panel section along a second fold line wherein said third panel section defines a back side of the three-sided head covering;

said tab joining said first panel section to said third panel section of the three sided head covering.

2. The head covering of claim 1, wherein said joined panels are collapsible into a substantially coplanar storage position.

wherein the first, second and third panel sections are at least partially joined and adapted to cooperate to at least partially cover the head of a wearer.

3. The head covering of claim 1, wherein the first and second panel sections while in the substantially coplanar storage position are disposed in an opposing relation.

* * * * *